United States Patent [19]

Froes et al.

[11] Patent Number: 4,746,374

[45] Date of Patent: May 24, 1988

[54] METHOD OF PRODUCING TITANIUM ALUMINIDE METAL MATRIX COMPOSITE ARTICLES

[75] Inventors: Francis H. Froes, Xenia; Daniel Eylon, Dayton, both of Ohio

[73] Assignee: The United States of America as represented by the Secretary of the Air Force, Washington, D.C.

[21] Appl. No.: 13,817

[22] Filed: Feb. 12, 1987

[51] Int. Cl.[4] ..... C22F 1/18; B32B 15/14

[52] U.S. Cl. ..... 148/11.5 F; 148/11.5 Q; 428/614

[58] Field of Search ..... 148/11.5 Q, 11.5 F, 148/11.5 R, 2; 428/61 Y, 608; 228/190

[56] References Cited

U.S. PATENT DOCUMENTS

| | | | |
|---|---|---|---|
| 3,538,593 | 11/1970 | King et al. | 228/190 |
| 3,748,721 | 7/1973 | Alexander | 29/471.3 |
| 3,991,928 | 11/1976 | Friedrich et al. | 228/190 |
| 4,010,884 | 3/1977 | Rothman | 228/190 |
| 4,469,757 | 9/1984 | Ghosh et al. | 428/614 |
| 4,499,156 | 2/1985 | Smith et al. | 428/614 |
| 4,529,458 | 7/1985 | Kushnick et al. | 228/190 |
| 4,547,435 | 10/1985 | Yamatsuta et al. | 428/614 |

OTHER PUBLICATIONS

Brent R. Collins et al., "Property and Fracture Modes of Borsic-Titanium", NTIS Article AD-776793, Dec. 1972, pp. 1-29.

J. C. Williams, "Precipitation in Titanium-Base Alloys", Titanium Technology: Present Status and Future Trends, Titanium Development Association, 1985, pp. 75-86.

D. Eylon, C. M. Cooke, and F. H. Froes, "Production of Metal Matrix Composites from Rapidly Solidified Titanium Rapid Alloy Foils", Titanium Rapid Solidification Technology, The Metallurgical Society, Inc., publ. Oct. 1986, pp. 311-322.

*Primary Examiner*—John J. Zimmerman

*Attorney, Agent, or Firm*—Charles E. Bricker; Donald J. Singer

[57] ABSTRACT

A method for fabricating an improved titanium alloy composite consisting of at least one high strength/high stiffness filament or fiber embedded in a titanium-aluminum base alloy matrix which comprises the steps of providing a rapidly-solidified foil made of the titanium-aluminum base alloy, fabricating a preform consisting of alternating layers of the rapidly-solidified foil and the filamentary material, and applying heat and pressure to consolidate the preform, wherein consolidation is carried out at a temperature below the beta-transus temperature of the alloy.

11 Claims, 1 Drawing Sheet

METHOD OF PRODUCING TITANIUM ALUMINIDE METAL MATRIX COMPOSITE ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to a method for fabricating filamentreinforced composite articles. In particular, this invention is directed to a method for fabricating filament-reinforced titanium aluminide matrix composite materials.

Composite metallic structures, which are reinforced with high strength, high modulus filaments or fibers having a high length-to-diameter ratio, have been demonstarted to have high specific properties. With particular respect to the aerospace industry, titanium-based composites have been considered for high temperature applications because of the high-temperature strength and low density of titanium and its alloys. Fiber-reinforced titanium-based composites exhibit increased temperature capability, improved shear, transverse, and off-axis properties; and better erosive environment durability when compared with presently available aluminum matrix and polymeric matrix composite systems.

Previous attempts to fabricate fiber-reinforced titanium alloy matrix composite materials have met with only limited success. In order to provide a usable product, sheets of the matrix material and layers of the reinforcing fibers are stacked so that the top of each reinforcing fiber is positioned opposite the bottom of a superimposed metal sheet. The stacked layers are laminated, typically by a vacuum hot pressing operation, into an integrally bonded composite structure. It has been established that, at consolidation temperatures sufficiently high to promote bonding of titanium matrix material, layer to layer within the stack, an interfacial reaction can occur between the fibers and the matrix, resulting in the formation of a layer of intermetallic compound. Fracture events within the plurality of brittle layers of intermetallic compound which occur throughout the laminate have limited the strain capability and thus the strength of previously available titanium composite materials.

Titanium-aluminum alloys containing about 10 to 50 atomic percent Al and about 80 to 50 atomic percent Ti in addition to other alloying elements have been recognized for some time. These alloys are ordered and divided into two major groups: the $\alpha_2$ alloys are based on the intermetallic compound $Ti_3Al$, and the alloys based on the intermetallic compound TiAl. Both groups are referred to as titanium aluminides and have good high temperature strength and oxidation and creep resistance, but are relatively brittle and hard to handle at room temperature.

Fiber-reinforced titanium aluminide matrix alloy composites, in which the alloy contains more than about 10 at .% Al, are currently used only on an experimental basis. Attempts to roll these alloys into sheetstock thinner than about 0.5 mm have provided little success. Consequently, researchers wishing to employ these alloys in fabricating composite materials have had to resort to chemical milling or grinding of sheetstock in order to provide foil of desired thickness, typically about 0.1 to 0.3 mm, thereby greatly increasing material cost.

The high temperature resistance of titanium-aluminide base alloys containing more than about 10 atomic percent Al requires higher composite consolidation and bonding temperatures. Such higher temperatures generally increase the interfacial reactions between the composite reinforcing fibers and the alloy matrix. What is desired is a method for producing composite sructures from titanium-aluminide base alloys containing more than 10 atomic percent A1 wherein the reaction zone, i.e., the region of reaction at the interface between the matrix and the fiber, is minimized, if not eliminated.

It is therefore an object of the present invention to provide an improved method for fabricating composite structures using a titanium-aluminum alloy containing at least about 10 atomic percent Al.

Other objects, aspects and advantages of the present invention will be apparent to those skilled in the art from a reading of the following description.

SUMMARY OF THE INVENTION

In accordance with the present invention there is provided a method for fabricating a composite structure consisting of a filamentary material selected from the group consisting of silicon carbide, silicon carbide-coated boron, boron carbide-coated boron and silicon-coated silicon carbide, embedded in a titanium-aluminum alloy matrix, wherein the matrix alloy contains at least 10 atomic percent aluminum. The method of this invention comprises the steps of providing a rapidly-solidified foil made of a titanium-aluminum alloy containing about 10 to 50 atomic percent aluminum and about 80 to 50 atomic percent titanium, fabricating a preform consisting of alternating layers of the rapidly-solidified foil and at least one of the aforementioned filamentary materials, and applying heat and pressure to consolidate the preform, wherein consolidation is carried out at a pressure of about 5 to 40 ksi and a temperature of about 1400° to 2300° F.

DETAILED DESCRIPTION OF THE INVENTION

Figure 1:
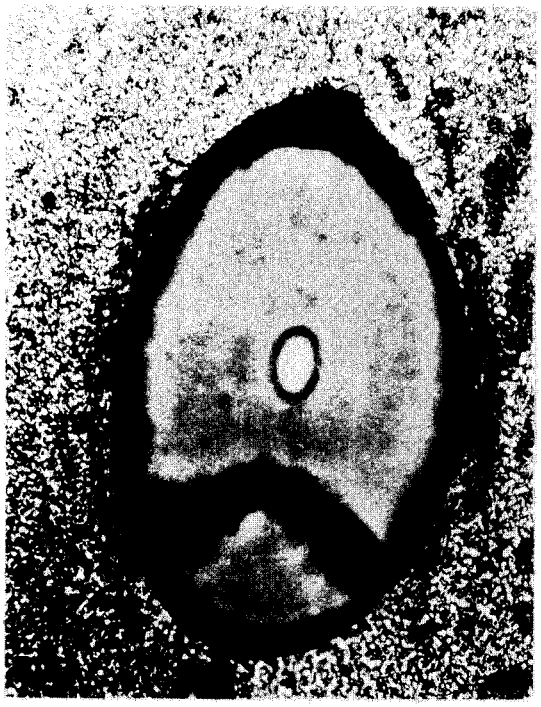
FIG. 1 is a 400× photomicrograph of a portion of a composite prepared using rapidly-solidified Ti-14Al-22Nb ribbon and SCS-6 fiber.

Titanium-aluminum alloys suitable for use in the present invention are those alloys containing about 10 to 50 atomic percent aluminum and about 80 to 50 atomic percent titanium. These alloys are known collectively as titanium aluminides. In addition, the Ti-Al alloy may contain varying amounts of other elements, such as, for example, Nb, Mo, V and W. Examples of titanium aluminide alloys include Ti-36Al, Ti-15.8Al, Ti-14Al-22Nb, Ti-14.3Al-19.7Nb, Ti-15Al-10.3Nb, Ti-15.4Al-5.3Nb, Ti-31.5Al, Ti-14.6Al-10Nb-4W and Ti-6.6Al-15.6Mo.

Several techniques are known for producing rapidly solidified foil, including those known in the art as Chill Block Melt Spinning (CBMS), planar Flow Casting (PFC), melt drag (MD), Crucible Melt Extraction (CME), Melt Overflow (MO) and Pendant Drop Melt Extraction (PDME). Typically, these techniques employ a cooling rate of about $10^5$ to $10^7$ deg-K/sec and produce a material about 10 to 100 micrometers thick, with an average beta grain size of about 2 to 20 microns, which is substantially smaller than the beta grain size produced by ingot metallurgy methods.

The high strength/high stiffness filaments or fibers employed according to the present invention are produced by chemical vapor deposition of boron or silicon carbide to a desired thickness onto a suitable substrate, such as carbon monofilament or very fine tungsten wire. This reinforcing filament may be further coated with boron carbide, silicon carbide or silicon. To reiterate, at least four high strength/high stiffness filaments or fibers are commercially available: silicon carbide, silicon carbide-coated boron, boron carbide-coated boron, and silicon-coated silicon carbide.

For ease of handling it is desirable to introduce the filamentary material into the composite in the form of a sheet. Such a sheet may be fabricated by laying out a plurality of filaments in parallel relation upon a suitable surface and wetting the filaments with a fugitive thermoplastic binder, such as polystyrene. After the binder has solidified, the filamentary material can be handled as one would handle any sheet-like material.

The composite preform may be fabricated in any manner known in the art. For example, alternating plies of alloy foil and filamentary material may be stacked by hand in alernating fashion. The quantity of filamentary material included in the preform should be sufficient to provide about 25 to 45, preferably about 35 volume percent of fibers.

Consolidation of the filament/sheetstock preform is accomplished by application of heat and pressure over a period of time during which the matrix material is superplastically formed around the filaments to completely embed the filaments. Prior to consolidation, the fugitive binder, if used, must be removed without pyrolysis occurring. By utilizing a press equipped with heatable platens and a vacuum chamber surrounding at least the platens and press ram(s), removal of the binder and consolidation may be accomplished without having to relocate the preform from one piece of equipment to another.

The preform is placed in the press between the heatable platens and the vacuum chamber is evacuated. Heat is then applied gradually to cleanly off-gas the fugitive binder without pyrolysis occurring, if such fugitive binder is used. After consolidation temperature is reached, pressure is applied to achieve consolidation.

Consolidation is carried out at a temperature in the approximate range of 0° to 250° C. (0° to 450° F.) below the beta-transus temperature of the alloy. For example, the consolidation of a composite comprising Ti-14Al-22Nb alloy, which has a beta transus of about 1120° C. (2050° F.), is preferably carried out at about 925° C. (1700° F.). The pressure required for consolidation of the composite ranges from about 35 to about 300 MPa (about 5 to 40 Ksi) and the time for consolidation ranges from about 15 minutes to 24 hours or more. Consolidation under these conditions permits retention of the fine grain size of the alloy matrix.

The following example illustrates the invention:

EXAMPLE

Ti-14Al-22Nb ribbons produced by the pendant drop melt extraction (PDME) process, having a width of 2 mm, an average thickness of 72 microns and an average beta grain size of 2.8 microns, were cut into segments of about 1 inch length. A layer of such segments was placed into a carburized steel cup lined with CP titanium foil. SCS-6 fibers were place on top of the ribbon segments. Another layer of the ribbon segments were placed over the fibers. Finally, a CP titanium foil cover was placed over the preform. A plug of carburized steel was fitted into the cup and the entire assembly was placed into a die for hot pressing.

Figure 2:
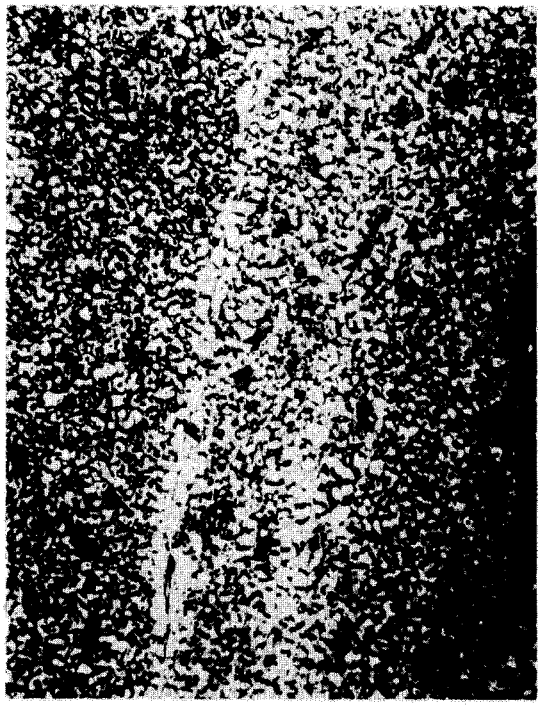
FIG. 2 is a 600× photomicrograph showing the fine microstructure of rapidly solidified Ti-14Al-22Nb alloy ribbon.
Figure 3:
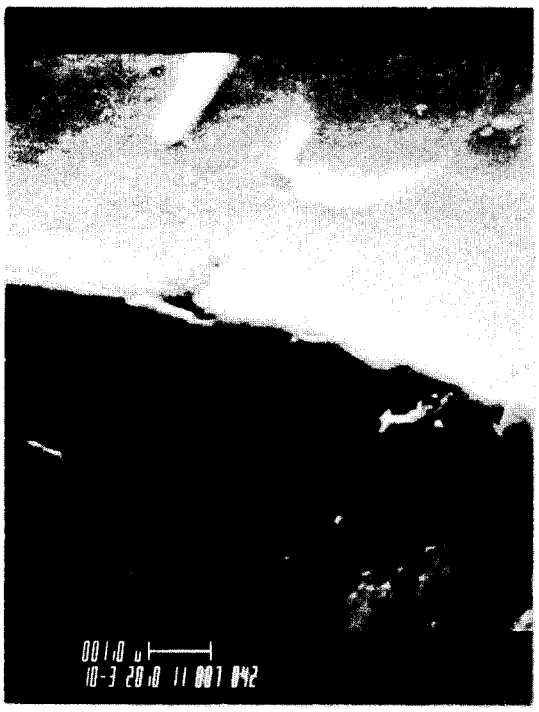
FIG. 3 is a 1000× photomicrograph showing the alloy/fiber reaction zone of the composite of FIG. 1.

The preform was compacted at 925° C. (1700° F.) at 35 Ksi for 2 hours. The resulting composite is shown in FIG. 1 which illustrates complete bonding between the SCS-6 fiber and the Ti-14Al-22Nb ribbon. The fine grain structure of the ribbon, prior to compaction, is shown in FIG. 2. FIG. 3 illustrates the very limited reaction zone between the fiber and the alloy.

Figure 4:
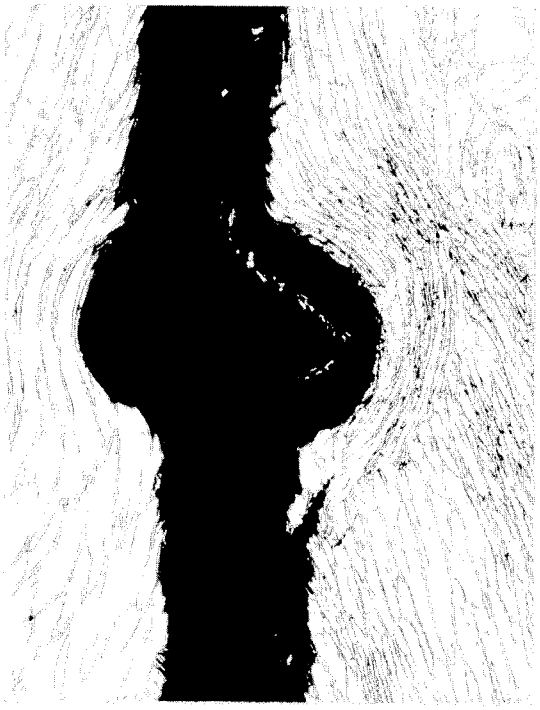
FIG. 4 is a 200× photomicrograph showing an attempt to produce a composite using thinned sheets of ingot metallurgy Ti-14Al-22Nb alloy.

For comparison, an attempt was made to prepare a composite using ingot metallurgy rolled Ti-14Al-22Nb foil following the procedure given above. The thickness of the rolled foil was further reduced to about 200 microns by grinding prior to fabrication of the preform. This preform was compacted under the same conditions as given above. FIG. 4 illustrates the absence of bonding of the metal layers as well as loss of the fibers. Another preform was prepared using these ground-to-thickness ingot metallurgy rolled foil segments, then consolidated at 1065° C. (1950° F.) at 8 Ksi for 2 hours. The result was identical with that shown in FIG. 4.

Various modifications may be made without departing from the spirit of the invention or the scope of the appended claims.

We claim:

1. A method for fabricating a titanium alloy composite consisting of at least one filamentary material selected from the group consisting of silicon carbide, silicon carbide-coated boron, boron carbide-coated boron, and silicon-coated silicon carbide, and a titanium-aluminum base alloy containing about 10 to 50 atomic percent aluminum and about 80 to 50 atomic percent titanium which comprises the steps of:

(a) providing rapidly-solidified foils, having an average beta grain size of about 2 to 20 microns, of said alloy;

(b) fabricating a preform consisting of alternating layers of at least one of said filamentary materials and said foil; and (c) applying heat at a level of about 0° to 250° C. below the beta transus temperature of said alloy and applying a pressure of about 5 to 40 ksi for about 0.25 to 24 hours, to consoliate said preform.

2. The method of claim 1 wherein the quantity of filamentary materials in said composite is about 25 to 45 volume percent.

3. The method of claim 1 wherein said alloy is Ti-14Al-22Nb.

4. The method of claim 1 wherein said alloy is Ti-36Al.

5. The method of claim 1 wherein said alloy is Ti-15.8Al.

6. The method of claim 1 wherein said alloy is Ti-14.3Al-19.7Nb.

7. The method of claim 1 wherein said alloy is Ti-15Al-10.3Nb.

8. The method of claim 1 wherein said alloy is Ti-15.4Al-5.3Nb.

9. The method of claim 1 wherein said alloy is Ti-31.5Al.

10. The method of claim 1 wherein said alloy is Ti-14.6Al-10Nb-4W.

11. The method of claim 1 wherein said alloy is Ti-6.6Al-15.6Mo.

* * * * *